United States Patent [19]

Calevich et al.

[11] 4,028,924

[45] June 14, 1977

[54] APPARATUS FOR CROSS-ROLLING WIRE LEADS

[75] Inventors: George J. Calevich, Cleveland; John E. McMillan; Grant W. Ticknor, both of Kirtland, all of Ohio

[73] Assignee: General Electric Company, Schenectady, N.Y.

[22] Filed: Apr. 9, 1976

[21] Appl. No.: 675,687

[52] U.S. Cl. ..... 72/252

[51] Int. Cl.[2] ..... B21B 39/14

[58] Field of Search ..... 29/DIG. 20, 25.17, 25.18, 29/630 A; 72/252, 199, 184, 133, 240, 191; 113/119

[56] References Cited

UNITED STATES PATENTS

| | | | |
|---|---|---|---|
| 29,702 | 8/1860 | Lauth | 72/252 |
| 1,001,116 | 8/1911 | York | 72/252 X |

*Primary Examiner*—Milton S. Mehr

*Attorney, Agent, or Firm*—Paul F. Wille; Lawrence R. Kempton; Frank L. Neuhauser

[57] ABSTRACT

Apparatus is disclosed for forming foil leads by cross-rolling the round lead wire in successive passes through a roll press. In each pass, the lead wire is transported completely through the pinch area to form a foil having a lenticular cross section.

10 Claims, 6 Drawing Figures

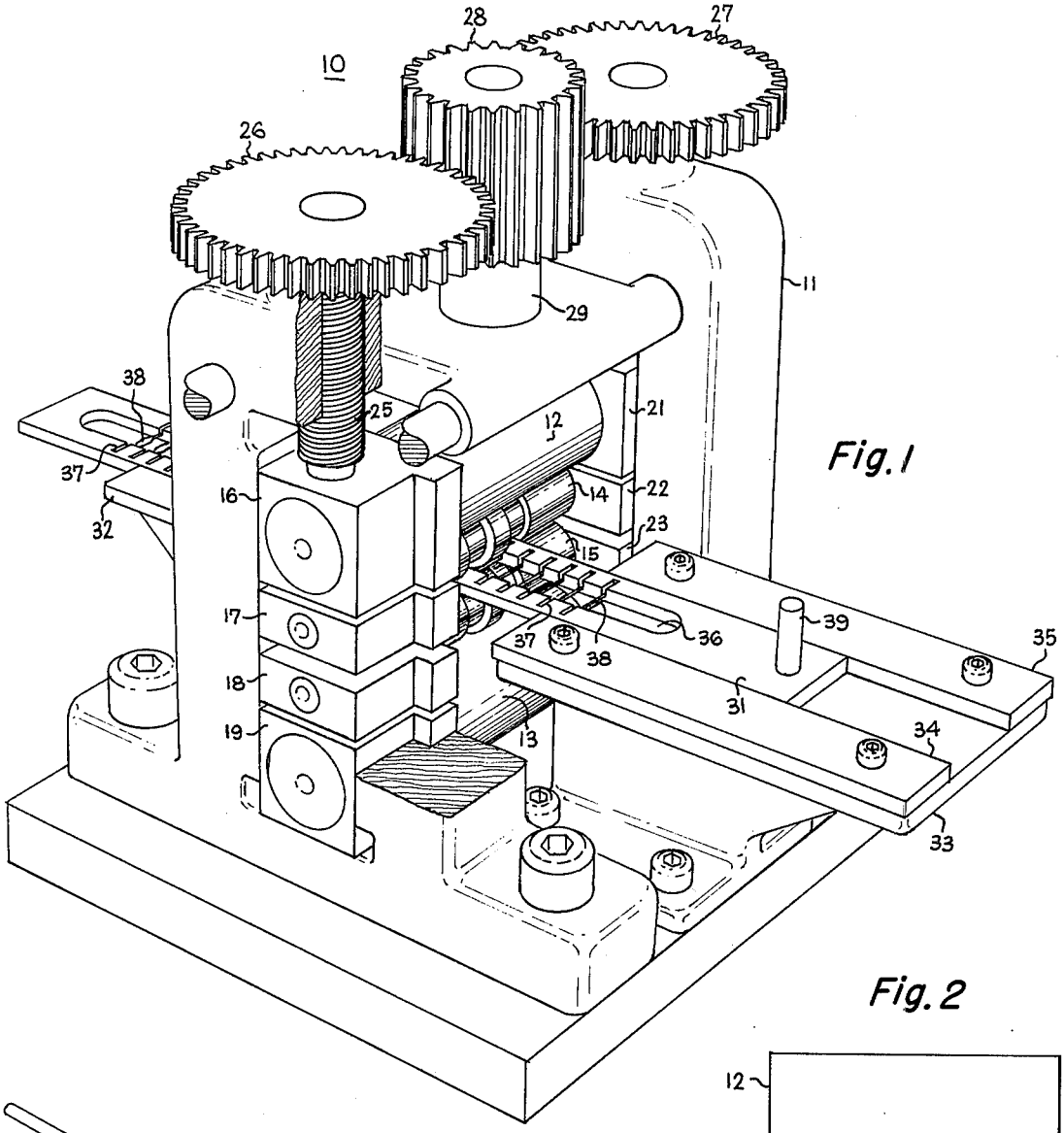
Fig. 1
Fig. 2
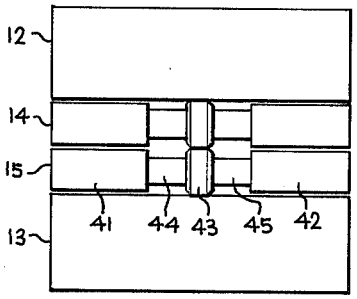
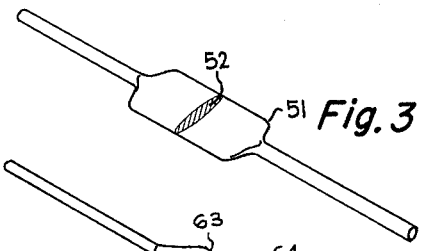
Fig. 3
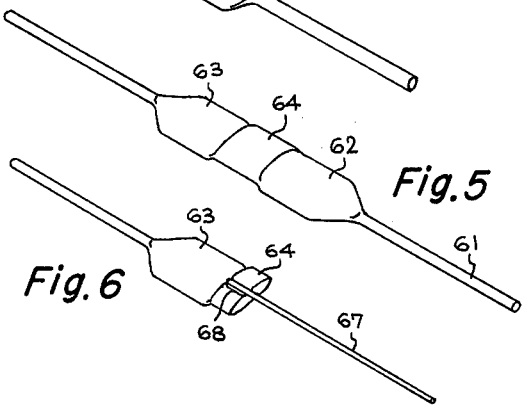
Fig. 5
Fig. 6
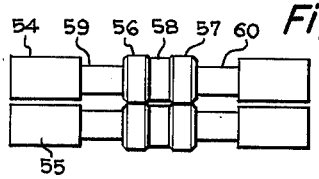
Fig. 4

APPARATUS FOR CROSS-ROLLING WIRE LEADS

BACKGROUND OF THE INVENTION

This invention relates to apparatus for use in lamp making and, in particular, to apparatus for cross-rolling a lead wire to form a flattened portion for sealing in a vitreous bulb.

In sealing a metallic conductor or lead wire through quartz or quartz-like glass, the high temperatures necessary for fusing quartz limits, for practical purposes, the choice of wire to molybdenum or tungsten. Both of these metals have coefficients of expansion much greater than that of quartz or quartz-like glass. For example, molybdenum has a coefficient of expansion approximately 10 times that of quartz. It is thus necessary to shape the wire so that the wire remains sealed to the quartz upon cooling. This is achieved by shaping a portion of the wire to increase the surface area thereof, typically in the form of a foil of approximately one-mil thickness. The foil portion of the lead bonds to the quartz and, upon cooling, undergoes tension but will not crack the quartz.

In the past, the foil has been formed by either longitudinal or cross-rolling the wire. In U.S. Pat. No. 3,102,443, for example, apparatus is described for cross-rolling the wire between two pivoting dies. A difficulty with this system is that the wire is rolled one segment at a time and requires pre-rolling treatment (flattening) to assure that the wire does not pop out from between the dies. Also, since the wire is supported by the dies, care must be taken to assure that the wire does not leave the pinch area and move out of position.

It is therefore desirable to have foil forming apparatus capable of operating on more than one wire at a time. Also, it is desirable to have the foil forming apparatus operate on round wire. In addition, it is desirable to have the foil formed with an elliptical or tapered cross section, feathered at the edges, to assure that the seal is not broken in this area when the quartz cools.

SUMMARY OF THE INVENTION

In view of the foregoing, it is therefore an object of the present invention to provide an improved apparatus for cross-rolling foil leads.

Another object of the present invention is to provide cross-rolling foil lead making apparatus capable of forming a plurality of leads at one time.

A further object of the present invention is to provide apparatus for cross-rolling round wire.

Another object of the present invention is to provide apparatus for making cross-rolled foil leads having tapered edges.

The foregoing objects are achieved in the present invention wherein a plurality of leads are held in a holder fitted between two rolls. In successive passes through the rolls, the spacing of the rolls is incrementally reduced to progressively flatten a segment of the lead wires. In each pass, the lead wires move completely through the pinch or contact area of the rolls, thereby providing a tapered cross section in the foil segment.

BRIEF DESCRIPTION OF THE DRAWINGS

A more complete understanding of the present invention can be obtained by considering the following detailed description in conjunction with the accompanying drawings, in which:

FIG. 1 illustrates a press in accordance with the present invention.

FIG. 2 illustrates a plan view of one set of rolls in accordance wth the present invention.

FIG. 3 illustrates lead wire formed by the apparatus of FIGS. 1 and 2.

FIG. 4 illustrates an alternative embodiment of work rolls in accordance with the present invention.

FIG. 5 illustrates lead wire formed with the rolls of FIG. 4.

FIG. 6 illustrates completed lead wire in accordance with the present invention.

DESCRIPTION OF THE PREFERRED EMBODIMENTS

As illustrated in FIG. 1, the roll press in accordance with the present invention comprises a frame 11, which may comprise cast iron or other suitable material, for holding in place drive rolls 12 and 13 and work rolls 14 and 15 positioned therebetween. The drive and work rolls are held in position within frame 11 by bearing nests comprising bearings 16-19 and 21-23 (the bearing for drive roll 13 cannot be seen in this view). Specifically, drive roll 12 is held in place by bearings 16 and 21; work roll 14 is held in place by bearings 17 and 22; work roll 15 is held in place by bearings 18 and 23; and drive roll 13 is held in place by bearing 19 and by a corresponding bearing on the other side of roll press 10. The bearing nests are suitably shaped to fit within frame 11 and hold the rolls in parallel alignment.

The pressure applied by work rolls 14 and 15 is controlled by screw 25 and a corresponding screw on the other side of roll press 10. Screw 25 is mounted in a suitably bored and threaded hole through frame 11 and is turned by screw-down gear 26, while the corresponding screw on the other side of frame 11 is rotated by screw-down gear 27. The rotation of gears 26 and 27 is coordinated so as to provide uniform pressure across the work area of rolls 14 and 15 by central drive gear 28 mounted on gear shaft 29.

Holder 31 is provided for holding a plurality of lead wires parallel to and passing them between work rolls 14 and 15. Holder 31 is mounted in a channel on support 33 defined between plates 34 and 35 which are suitably mounted to support 33. On the opposite side of roll press 10 is a similar support 32 for receiving holder 31 after it passes between work rolls 14 and 15.

Holder 31 is provided with a central aperture or channel 36, the reason for which may best be understood by considering FIG. 2 in which drive rolls 12 and 13 and work rolls 14 and 15 are illustrated in a plan view. Each of work rolls 14 and 15 comprise end portions 41 and 42 and a central portion or work area 43 which does the actual rolling of the lead wires in accordance with the present invention. As illustrated in FIG. 2, work area 43 preferably has radiused edges to prevent cutting of the lead wire. Interconnecting work area 43 with ends 41 and 42 are reduced diameter portions 44 and 45, respectively. Channel 36 in holder 31 is proportioned to fit around work area 43 of work rolls 14 and 15. Similarly, reduced diameter portions 44 and 45 of work rolls 14 and 15 are proportioned to provide clearance for holder 31.

Reconsidering FIG. 1, holder 31 is provided with a plurality of pairs of slots 37 positioned on opposite sides of channel 26. Each pair of slots supports one lead wire during the rolling process.

In operation, holder 31 is filled with lead wires and passed through work rolls 14 and 15 a plurality of times, with progressively increasing pressure applied by work rolls 14 and 15 during successive passes or groups of passes in accordance with an empirically determined rolling schedule for each thickness of wire. The actuation of holder 31 may be by means of pin 39 driven by any suitable means known in the art. Similarly, the control of the pressure applied by the work rolls, by way of gears 26–28, as well as the turning of drive rolls 12 and 13 may be by any suitable means known in the art and form no part of the present invention.

FIG. 3 illustrates a foil lead formed by the apparatus illustrated in FIGS. 1 and 2. As can be seen by inspection of FIG. 3, the lead wire is provided with a rolled portion 51 having an elliptical cross section 52 of large eccentricity. Alternatively, cross section 52 may be considered as having a tapered cross section, feathered at the edges. It is preferred that holder 31 make an even number of passes throgh work rolls 14 and 15 so that cross section 52 is substantially symmetrical from edge to edge about the axis defined by the round portion of the lead wire.

While roll press 10 greatly enhances the speed of production of foil leads in that large numbers of leads can be produced in a given time from the roll press, rather than one at a time, roll press 10 can be modified to double the production of foil leads by modifying the work rolls as illustrated in FIG. 4. Specifically, work rolls 54 and 55 are each provided with two work areas 56 and 57. Interconnecting the work areas is a reduced diameter portion 58 which need not be the same as reduced diameters 59 and 60 which are used for clearance of holder 31. Preferably, diameter 58 differs from the diameter of work areas 56 and 57 by 0.001 inches so that rolling of the lead wire is performed by central diameter 58. As with work area 43, work areas 56 and 57 are preferably radiused to prevent cutting of the lead wires during rolling.

FIG. 5 illustrates a lead wire as formed by work rolls 54 and 55. Specifically, lead wire 61 is provided with two rolled portions 62 and 63 having elliptical cross sections similar to cross section 52 of FIG. 3. Interconnecting rolled portions 62 and 63 is a partially rolled thicker portion 64. In subsequent operations, lead wire 61 is bisected through section 64, as illustrated in FIG. 6, and a suitable lead wire 67 attached thereto, for example by welding. Thicker portion 64 thus provides adequate support and material for forming weld 68 to lead 67. Thus, in using the alternative embodiment illustrated in FIG. 4, the already high production rate achievable with the roll press of the present invention is effectively doubled.

Having thus described the invention, it will be apparent to those of skill in the art that various modifications can be made within the spirit and scope of the present invention. For example, while the illustration of slots 37 would indicate that they were formed by milling, it is understood that they may be formed by any suitable means, e.g., by impression with a tool. While omitted for clarity in FIG. 1, the lead wires are held in place by any suitable means, e.g., tape or metal having a longitudinal channel and overlying holder 31.

What we claim as new and desire to secure by Letters Patent of the United States is:

1. A roll press for forming a lenticular cross section in a portion of a plurality of lead wires comprising:

first and second drive rolls;

first and second work rolls for forming said lenticular cross section positioned between said drive rolls, wherein the axes of said rolls are substantially parallel;

holder means adapted to carry a plurality of lead wires for conveying said lead wires between said work rolls; and pressure means for causing said work rolls to subject said lead wires to a predetermined pressure as said lead wires are conveyed therebetween.

2. The roll press as set forth in claim 1 wherein said holder comprises a longitudinal cutout across which said plurality of lead wires are suspended.

3. The roll press as set forth in claim 2 wherein said holder comprises a plurality of slots along said cutout for holding said lead wires parallel to said work rolls.

4. The roll press as set forth in claim 2 wherein said work rolls are shaped so that said holder does not engage the work rolls when conveying lead wires therebetween.

5. The roll press as set forth in claim 4 wherein each of said work rolls has a work area of greater diameter than the portions on either side and a longitudinal dimension less than the width of said cutout.

6. The roll press as set forth in claim 5 wherein said work area has radiused edges.

7. The roll press as set forth in claim 5 wherein each of said work rolls comprises two spaced apart work areas for forming a pair of said lenticular cross-section portions, said work areas being separated by a central segment having a smaller diameter than said work areas.

8. The roll press as set forth in claim 7 wherein said central segment has a diameter greater than the diameter of the portions outside said work areas.

9. The roll press as set forth in claim 8 wherein the central segments of said work rolls contact the lead wires with less pressure than said work areas.

10. The roll press as set forth in claim 9 wherein the edges of said work areas are radiused.

* * * * *